US005433621A

United States Patent [19]

Sai

[11] Patent Number: 5,433,621

[45] Date of Patent: Jul. 18, 1995

[54] WATERPROOF PLUG AND WIRE TERMINAL WITH THE WATERPROOF PLUG

[75] Inventor: Noriaki Sai, Yokohamashi, Japan

[73] Assignee: The Whitaker Corporation, Wilmington, Del.

[21] Appl. No.: 249,480

[22] Filed: May 26, 1994

[30] Foreign Application Priority Data

Jul. 30, 1993 [JP] Japan ..... 5-045898 U

[51] Int. Cl.[6] ..... H01R 4/70

[52] U.S. Cl. ..... 439/275

[58] Field of Search ..... 439/274, 275, 587, 271, 439/589

[56] References Cited

U.S. PATENT DOCUMENTS 4,560,219 12/1985 Chapelot ..... 439/587
5,035,638 7/1991 Kourimsky ..... 439/275
5,352,126 10/1994 Kuboshima et al. ..... 439/587
5,364,285 11/1994 Sakurai ..... 439/275

*Primary Examiner*—Gary F. Paumen
*Attorney, Agent, or Firm*—Timothy J. Aberle; Adrian J. LaRue

[57] ABSTRACT

The front section (2) of the waterproof plug (1) has an opening (10) of a small diameter, and its rear section (8) has an opening of a large diameter. When the waterproof plug (1) is placed over the wire with its conductor (94) exposed by stripping the insulation (92) from the end of the wire, the small diameter opening (10) and the large diameter opening (12) fit tightly over the conductor (94) and the insulation (92), respectively. A pin contact (40) is attached to the wire tip (96) by crimping, and the waterproof plug (1) is retained between the crimping section (46) of the pin contact (40) and the insulation (92) of the wire (90).

6 Claims, 4 Drawing Sheets

WATERPROOF PLUG AND WIRE TERMINAL WITH THE WATERPROOF PLUG

This invention relates to waterproof plugs and wire terminals with waterproof plugs, especially to waterproof plugs attached to the insulated portion of a wire connected to a contact, and to wire terminals with waterproof plugs.

BACKGROUND OF THE ART

A number of methods for creating waterproof structures by attaching a waterproof plug to a wire for waterproof connectors is known in the art. For the best known type of such structures among waterproof plugs one can refer to a waterproof plug described in JP Utility Model (1993)-17958. This waterproof plug is a cylindrical body with several circular rings, and its front cylindrical portion is fixed to the wire end over its insulation as a contact insulation barrier. The main disadvantage of the waterproof plug of such a type is the necessity to use a crimping process, otherwise the contact will not have an insulation barrier.

Another conventional example of a waterproof plug retaining structure is shown in FIG. 5. This retaining structure consists of a roughly cylindrical waterproof plug 100 having several circular ribs 101 placed over wire 90″. It is retained over the wire 90″ by means of retaining devices 106, 116 located at both ends 102, 104 of the plug. Retaining device 106 has a flange-type expanded retaining section 108 which is pressed against the end surface 102 and an insulation barrier 110 which is crimped over the wire 90″. Retaining device 116 has a retaining section 118, of the same shape as the retaining section 108, which is pressed against the end surface 104 of the waterproof plug 100 and a crimped section 120 of a solderless contact connected to the wire 90.″ The waterproof plug 100 is fixed to the wire 90″ by being sandwiched between two retaining devices 108 and 118. This retaining structure requires several assembly operations to attach the plug to the wire 90″. In addition, this design is not suitable for high density assemblies, since the retaining sections 108, 118 expand outward. Another problem consists in a large number of components.

The purpose of this invention is to offer a waterproof plug and a wire terminal with the waterproof plug of a simple design suitable for high-density assembly having a small number of components.

SUMMARY OF THE INVENTION

A waterproof plug according to this invention is attached to a wire connected to a contact prevents water from getting into the receptacle cavity of the contact to which the above mentioned contact is connected, and is characterized by the fact that it has an opening of a small diameter in its front portion and an opening of a large diameter in its rear portion, and when it is placed over the tip of wire whose end is stripped of insulation, these small and large-diameter openings fit tightly over said conductor and insulation.

A wire terminal with a waterproof plug according to this invention attached to the wire end to which a contact is connected prevents water from getting into the receptacle cavity of the contact to which the above mentioned contact is connected, and it has an opening of a small diameter in its front portion and an opening of a large diameter in its rear portion, and when it is placed over the tip of wire whose end is stripped of insulation, these small and large-diameter openings fit tightly over said conductor and insulation, and is characterized by the fact that said waterproof plug is retained between the crimped portion of the solderless contact fixed to the exposed conductor of the wire and the above mentioned insulated portion of the wire.

Below, we will give detailed explanations, with reference to the drawings, concerning embodiments of the waterproof plug and the wire terminal with such a waterproof plug (referred to below as simply "wire terminal") according to this invention.

BRIEF DESCRIPTION OF THE DRAWINGS

FIG. 2 B is an oblique view from the back of the waterproof plug shown in the FIG. 2 A.

FIG. 4 B is an oblique view with a partial cut out of the waterproof plug shown in FIG. 4 A.

DETAILED DESCRIPTION OF THE INVENTION

Figure 1:
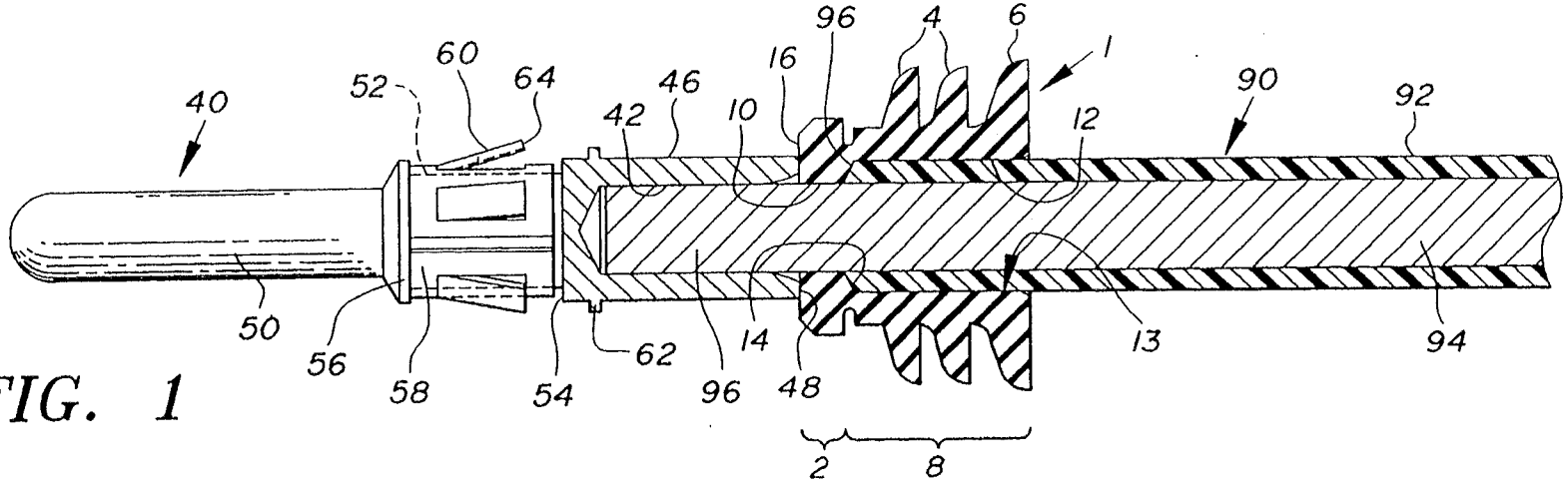
FIG. 1 is a front view of the first embodiment of the wire terminal with the waterproof plug according to this invention with a partially sectioned wire terminal.

FIG. 1 represents the first embodiment of the wire terminal according to this invention. The wire 90 consists of a vinyl (or other material) insulation 92 and a conductor 94. The conductor 94 may be a solid wire or a multistrand twisted wire. A waterproof plug 1 is placed over an exposed end of the conductor 94 of the wire 90, and a solderless pin contact (contact) 40 is crimped to the tip of the conductor 94. The waterproof plug 1 of a roughly cylindrical shape is made of rubber or other elastic material, and it consists of a flange 2 at its front, and a rear portion 8 having circular ribs 4 and 6. In the middle of the front portion 2 and the rear portion 8, a small diameter opening 10 and a large diameter opening 12, respectively, are made. The small diameter opening 10 and the large diameter opening 12 are connected by a through hole 13. The inner diameters of the small opening 10 and the large opening 12 are roughly equal to the outer diameter of the conductor 94 and the insulated portion of the wire 92, respectively. The step 14 appearing due to the difference in diameters of the small opening 10 and large opening 12 forms an inclined circular surface. This surface facilitates the insertion of the conductor 94 when the waterproof plug 1 is placed over the wire, however it should not necessarily be inclined. The step 14 fits the front edge 96 of the insulation 92 remaining after stripping, and the waterproof plug 1 fits tightly on the conductor 94 and the insulation 92 of the wire 90. Therefore, the through hole 13 provides an additional tight fitting over the wire end stripped of the insulation.

Next, a pin contact 40 having a conductor receptacle hole 42 of a diameter which is approximately equal to the diameter of the conductor 94 is placed over the tip 96 of the conductor 94, and its crimping section 46 is crimped to the conductor 94. At this time, the rear end 48 of the crimping section 46 comes in contact with the front end 16 of the front section 2 of waterproof plug 1. Therefore, the waterproof plug 1 becomes sandwiched between the rear end 48 of the pin contact 40 and the front end 96 of the insulation 92 of the wire 90. When the waterproof plug 1 mounted this way is inserted in a terminal receptacle cavity (not shown in the drawing) of a connector housing (not shown in the drawing) by pushing the wire 90, it will be reliably held in the terminal receptacle cavity by friction without any additional retaining parts. Upon contact with the inner walls of the terminal receptacle cavity, ribs 4 and 6 become bent backward and compressed, thus providing an additional tightening means. Since the outer diameter of the front section 2 is almost the same as the inside diameter of the terminal receptacle cavity, the front section 2 plays the role of a guiding tip, thus making the insertion of the waterproof plug 1 easier. At the same time, this reduces the risk of tearing the front section 2 and increases the reliability of the waterproof structure.

The pin contact 40 is made as a single piece from copper or other similar material, and it has a cylindrical contacting section 50 fitting in a matching receptacle contact (not shown in the drawing), a crimping section 46, and a retaining section 52 located between two previous sections. The retaining section 52 is of a cylindrical shape and is limited by the front end 54 of the crimping section 46. In addition, a flange 56 is formed between the contacting section 50 and the retaining section 52. A locking device 58 is attached to the retaining section 52; it is made of stainless steel or a similar material bent into a cylindrical form. Several contact lances 60 are cut out in the locking device 58. In the front of the crimping section 46, several lugs 62 are made. When the pin contact 40 is inserted in the housing, the contact lances 60 are bent down, and a portion of the housing becomes retained between the rear ends 64 of the contact lances 60 and the lugs 62, thus retaining the pin contact 40 in the housing.

Figure 2A:
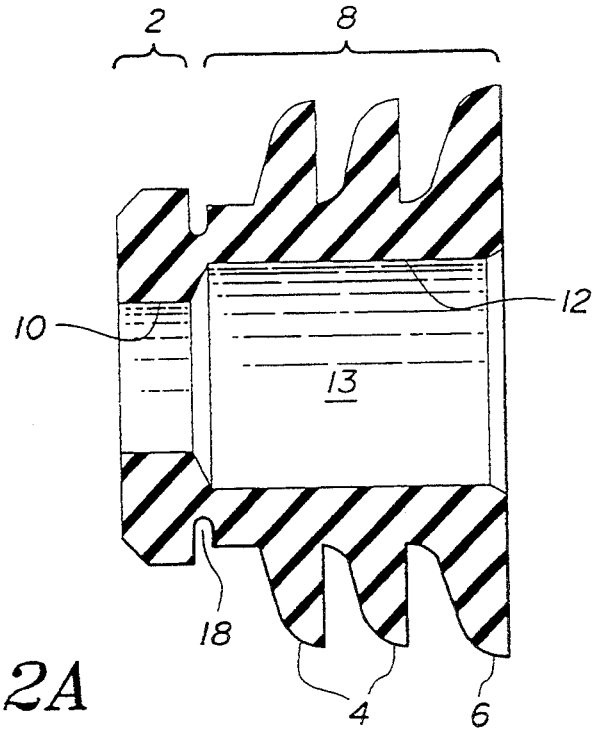
FIG. 2 A is a longitudinal cross section of the first embodiment of the waterproof plug according to this invention.
Figure 2B:
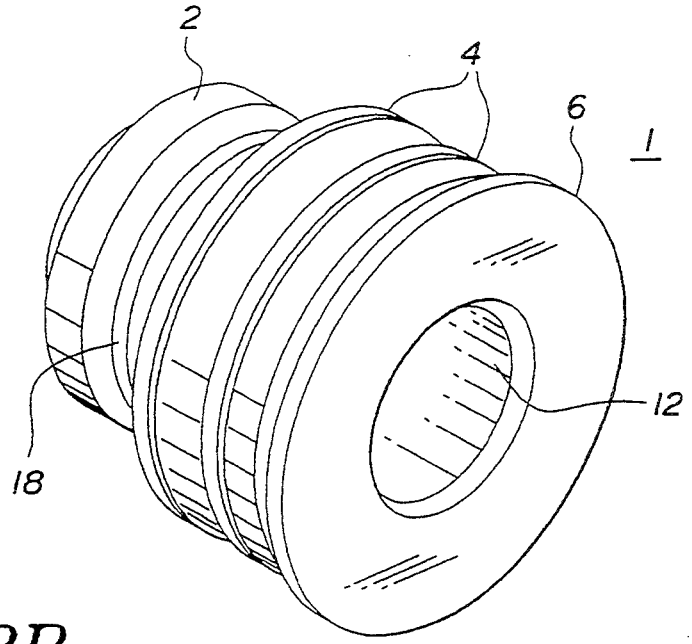

FIG. 2 A is a cross section of the first embodiment of the waterproof plug shown in FIG. 1. A circular groove 18 is made between the front section 2 and the rear section 8 whose purpose is to absorb deformations taking place along the radius and axis of the waterproof plug 1. The rib 6 is made larger than ribs 4 in order to provide a better resistance to the stresses produced by the bending of the wire 90.

FIG. 2 B is an oblique view of the waterproof plug 1 as seen from the back. This drawing gives a good rendering of the overall shape of the plug.

Figure 3:
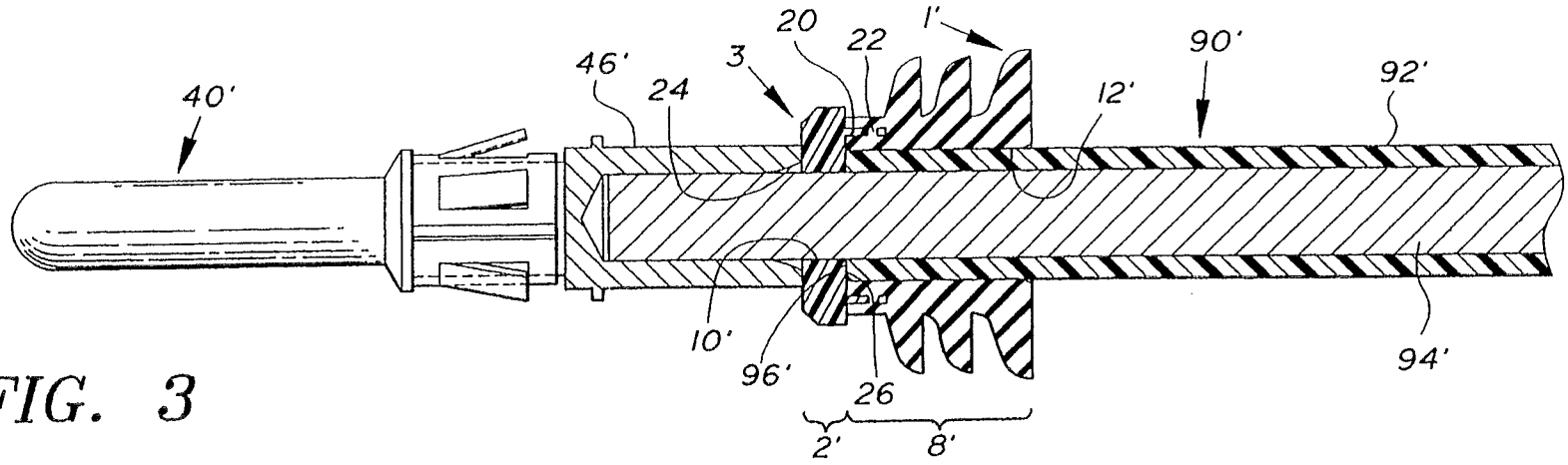
FIG. 3 is a front view of the second embodiment of the wire terminal with the waterproof plug according to this invention with a partially sectioned wire terminal.

FIG. 3 represents the second embodiment of the wire terminal according to this invention. In this drawing, the same position numbers (with an index ') are used for the same parts as in the first embodiment. The difference of the second embodiment from the first one is that the front section 2' of the waterproof plug 1' according to the second embodiment is a round piece made of a plastic. The circular portion 3 forming this front section 2' is molded together with the rear section 8'. The circular section 3 has the same shape as the front section 2 of the first embodiment of the waterproof plug 1, and it is molded together with its tubular portion 20 extending toward the rear section 8'. A number of holes 22 are made in the tubular portion 20 corresponding to the location of the front end of the rear section 8'. These holes 22 are filled with the rubber or other material from the rear section 8' when it is molded together with the front section 2', thereby providing their reliable connection.

As in the first embodiment, the front section 2' has a small diameter opening 10' fitting tightly over the conductor 94'. The small opening has tapered walls 24 to facilitate the insertion of the conductor 94' but the tapered part 24 is not essential. The large diameter opening 12' of the rear section 8' is for the insertion of the insulated portion 92' of the wire 90'. The front edge 96' of the insulation 92' comes into contact with the rear surface 26 of the circular section 3. Similarly to the first embodiment, the front section 2' of the waterproof plug 1' is retained by the crimping section 46' of the pin contact 40' and the front edge 96' of the insulation 92'. When the front section 2' is made of a plastic or a metal, the guiding effect during insertion of the pin contact 40' into a contact receptacle cavity is increased. It also reduces the possibility of cuts or deformation during the insertion. The front section 2' [sic] may be also made of rubber or another elastic material.

Figure 4A:
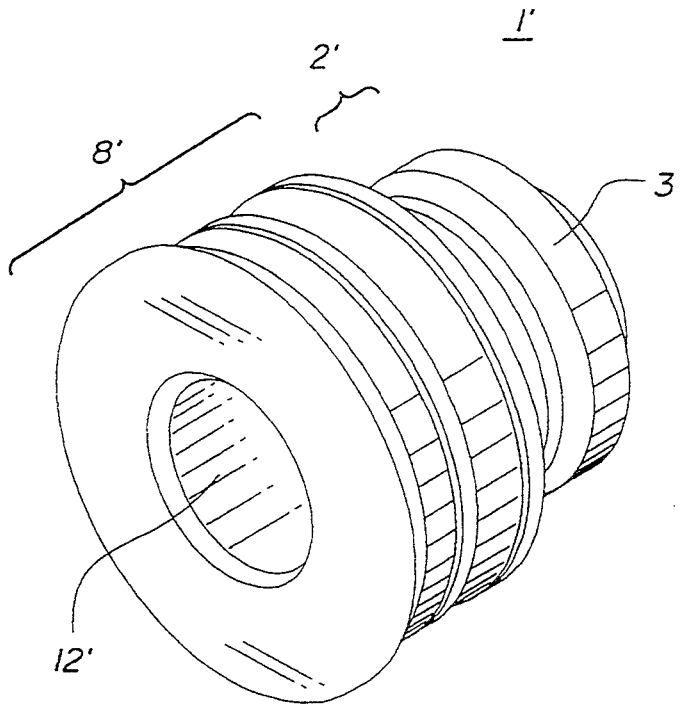
FIG. 4 A is an oblique rear view of the second embodiment of the waterproof plug.
Figure 4B:
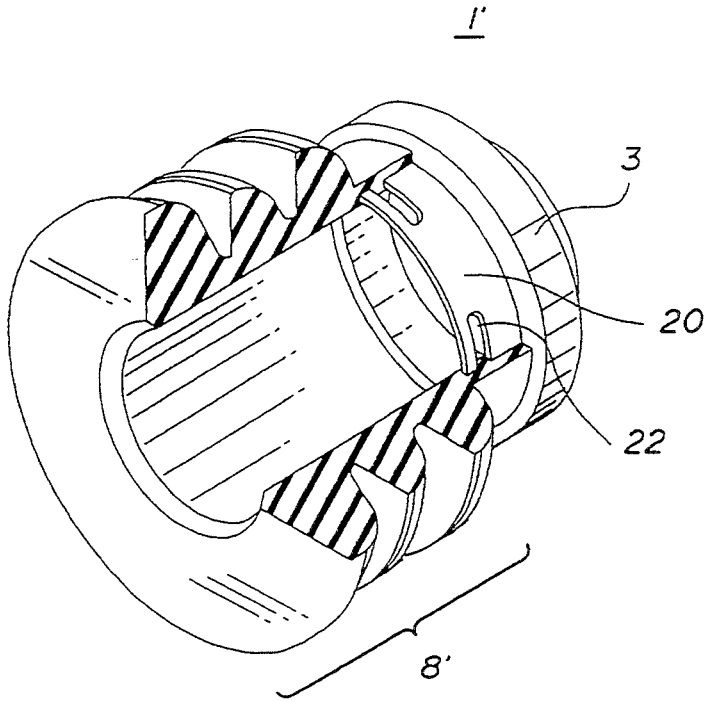
Figure 5:
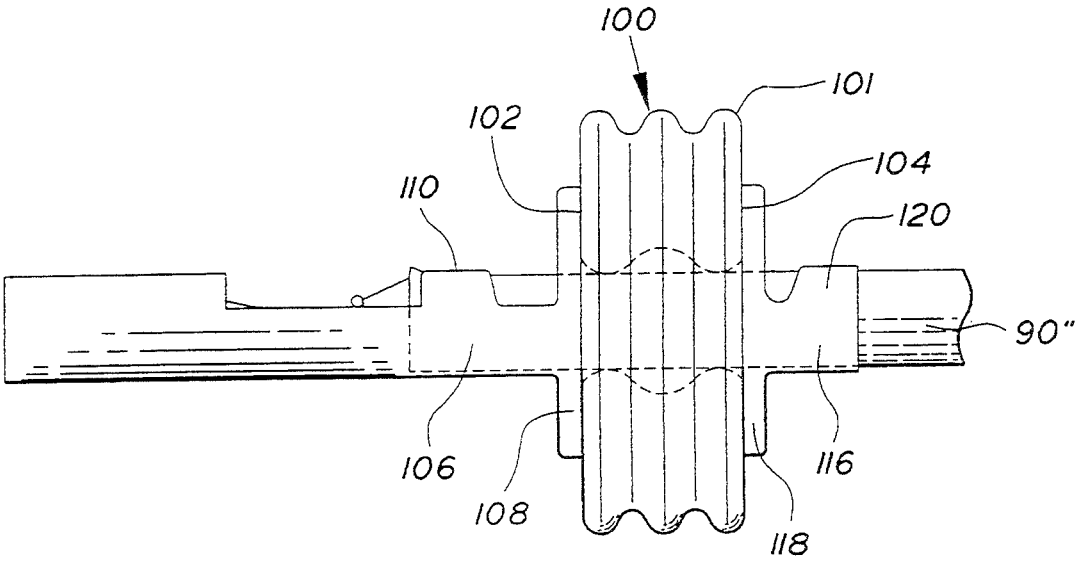
( PRIOR ART ) FIG. 5
FIG. 5 is a front view of a wire terminal with a waterproof plug of a conventional design.

FIG. 4 A is an oblique view of the waterproof plug 1' as seen from the back. The overall shape of the waterproof plug 1' is similar to that of the waterproof plug 1, except that the plug 1' does not have circular groove 18 present in the waterproof plug 1.

FIG. 4 B is an oblique view of the waterproof plug 1' shown in the FIG. 4 A with a partial cut out. In the cut out, one can clearly see the connection of the rear section 8' with the holes 22 of the circular section 3.

Above, we gave detailed explanations concerning preferred embodiments of the waterproof plug and the wire terminal according to this invention. And it is understood that this invention is not limited only to these embodiments, but also includes various modifications comprising the essential elements of this invention.

The waterproof plug according to this invention has an opening of small diameter in its front section and an opening of large diameter in its rear section which fit tightly respectively over the wire conductor stripped of the insulation and the insulated portion of the wire when the plug is placed over the wire. The wire terminal with the waterproof plug is attached by crimping to the wire with the waterproof plug placed over it in such a manner that the plug is retained between the crimping section of the contact and the wire insulation.

The waterproof plug according to this invention is of a very simple design having a small number of parts and it does not require additional operations for securing it to the wire. Therefore, the invention results in an easy to the manufacture, inexpensive product. And since it is possible to make its outer diameter small, it can be used in devices with high density assembly.

I claim:

1. A waterproof plug to be attached to an insulated wire connected to a contact, thus preventing water from getting into a receptacle cavity of a connector to which the contact is to be connected, characterized by the fact that said plug is formed with an opening of a small diameter in a front portion thereof and an opening of a large diameter in a rear portion thereof, and when the plug is placed over the tip of said wire whose end is stripped of insulation, the small and large diameter openings fit tightly over said tip and said insulation, respectively.

2. The plug of claim 1, wherein the front and rear portions are connected by a tapered surface, where said tapered surface is shaped to fit an end surface of said insulation.

3. The plug of claim 2, wherein said front portion is trapped between an end edge of said contact and said wire insulation.

4. A wire terminal with a waterproof plug attached to a wire end to which a contact is connected, thus preventing water from getting into a receptacle cavity of a connector to which the contact is to be connected, said waterproof plug is formed with an opening of a small diameter in a front portion thereof and an opening of a large diameter in a rear portion thereof, and when said plug is placed over the tip of the wire end which is stripped of insulation, the small and large diameter openings fit tightly over said tip and said insulation, respectively, characterized by the fact that said waterproof plug is retained between a crimped portion of the contact fixed to the tip of the wire and insulated portion of the wire.

5. The plug of claim 4, wherein the front portion is joined to the rear portion by a tubular portion which is molded into the rear portion.

6. The plug of claim 4, wherein the front and rear portions are made from different synthetic materials.

* * * * *